US007717976B2

(12) United States Patent
Coe et al.

(10) Patent No.: US 7,717,976 B2
(45) Date of Patent: May 18, 2010

(54) METHOD FOR MAKING STRAIN AGING RESISTANT STEEL

(75) Inventors: C. Larry Coe, Sterling, IL (US); Alan T. Gorton, Marietta, GA (US)

(73) Assignee: L&P Property Management Company, South Gate, CA (US)

( * ) Notice: Subject to any disclaimer, the term of this patent is extended or adjusted under 35 U.S.C. 154(b) by 501 days.

(21) Appl. No.: 11/012,030

(22) Filed: Dec. 14, 2004

(65) Prior Publication Data

US 2006/0124208 A1 Jun. 15, 2006

(51) Int. Cl.
*C22C 33/04* (2006.01)
*C21C 7/00* (2006.01)

(52) U.S. Cl. ..... 75/10.49; 75/10.48; 75/10.46; 75/10.15; 148/540; 148/598; 420/121; 420/128; 420/129; 420/126; 420/127

(58) Field of Classification Search ..... 148/595, 148/330, 328, 598–603, 540; 75/10.46, 10.48, 75/10.15, 10.49; 420/121, 126–129
See application file for complete search history.

(56) References Cited

U.S. PATENT DOCUMENTS

| | | | | |
|---|---|---|---|---|
| 3,847,682 | A | 11/1974 | Hook | 148/12.1 |
| 3,899,321 | A | 8/1975 | Oliver et al. | 75/49 |
| 3,928,087 | A | 12/1975 | Hook | 148/36 |
| 4,168,181 | A | 9/1979 | Perlus et al. | 148/2 |
| 4,233,065 | A | 11/1980 | Koul | 75/134 S |
| 4,251,268 | A | 2/1981 | Willim | 75/58 |
| 4,339,284 | A | 7/1982 | Hashimoto et al. | 148/12 C |
| 4,375,376 | A | 3/1983 | Rowden et al. | 148/12 F |
| 4,853,032 | A | 8/1989 | Yalamanchili et al. | 75/10.49 |
| 5,342,700 | A | 8/1994 | Arnaud et al. | 428/625 |
| 5,458,699 | A | 10/1995 | Tsukamoto et al. | 148/320 |
| 5,556,485 | A | 9/1996 | Taylor et al. | 148/320 |
| 5,595,617 | A | 1/1997 | Tonteling et al. | 148/595 |
| 5,656,102 | A | 8/1997 | Taylor et al. | 148/320 |
| 5,656,103 | A | 8/1997 | Roberts | 148/320 |

(Continued)

FOREIGN PATENT DOCUMENTS

CA 2293995 * 1/2000

(Continued)

OTHER PUBLICATIONS

English translation of Japanese patent 56-044747, Gennosuke Tenmiyo et al., Apr. 24, 1981.*

(Continued)

*Primary Examiner*—Deborah Yee
(74) *Attorney, Agent, or Firm*—Conely Rose, P.C.; Kristin Jordan Harkins

(57) ABSTRACT

A method for making a strain aging resistant steel comprises adding boron to the steel, wherein substantially all of the boron in the steel forms boron nitride. A method for making steel comprises adding a nitride-forming element to the steel to lower the free nitrogen content of the steel to a free nitrogen content specification. A high-carbon steel contains boron nitride, wherein the free nitrogen content of the steel is less than 80 ppm. A strain aging resistant steel wherein the carbon content of the steel is between about 0.54 percent and about 0.75 percent.

31 Claims, 3 Drawing Sheets

U.S. PATENT DOCUMENTS

| | | | | |
|---|---|---|---|---|
| 5,749,981 | A | 5/1998 | Tonteling et al. | 148/595 |
| 5,873,961 | A | 2/1999 | Bhagwat et al. | 148/595 |
| 6,264,759 | B1 | 7/2001 | Bae et al. | 148/320 |
| 6,322,641 | B1 | 11/2001 | Makii et al. | 148/330 |
| 6,395,107 | B1 | 5/2002 | Subramanian | 148/321 |
| 6,447,622 | B1 | 9/2002 | Yamada et al. | 148/320 |
| 6,537,395 | B2 | 3/2003 | Subramanian | 148/543 |
| 6,596,098 | B1 | 7/2003 | Nishida et al. | 148/320 |
| 6,676,774 | B2 | 1/2004 | Matsuoka et al. | 148/328 |
| 6,692,584 | B2 | 2/2004 | Sakata et al. | 148/320 |
| 6,695,932 | B2 | 2/2004 | Kami et al. | 148/320 |
| 6,702,904 | B2 | 3/2004 | Kami et al. | 148/320 |
| 6,743,306 | B2 | 6/2004 | Nakajima et al. | 148/328 |
| 6,767,417 | B2 | 7/2004 | Fujita et al. | 148/330 |
| 2001/0010181 | A1 | 8/2001 | Zasowski et al. | 75/304 |
| 2002/0036033 | A1 | 3/2002 | Subramanian | 148/321 |
| 2002/0148536 | A1 | 10/2002 | Nakajima et al. | 148/320 |
| 2003/0015263 | A1 | 1/2003 | Kami et al. | 148/603 |
| 2003/0047257 | A1 | 3/2003 | Kami et al. | 148/651 |
| 2003/0047258 | A1 | 3/2003 | Sakata et al. | 148/654 |
| 2003/0066575 | A1 | 4/2003 | Nagao et al. | 148/320 |
| 2003/0121576 | A1 | 7/2003 | Fujita et al. | 148/602 |
| 2003/0145920 | A1 | 8/2003 | Kami et al. | 148/651 |
| 2004/0103962 | A1 | 6/2004 | Kami et al. | 148/603 |
| 2004/0105997 | A1 | 6/2004 | Kami et al. | 428/615 |
| 2004/0118486 | A1 | 6/2004 | Zelin et al. | 148/522 |

FOREIGN PATENT DOCUMENTS

| | | | |
|---|---|---|---|
| JP | 56-44747 | * | 4/1981 |
| JP | 2000-144322 | * | 5/2000 |

OTHER PUBLICATIONS

English translation of Japanese patent 2000-144322, Sunao Yoshihara et al., May 26, 2000.*

Computer-generated English translation of Japanese patent 09287020, Toshiyuki Murakami et al., Nov. 4, 1997.*

"Classification of Carbon and Low-Alloy Steels," Knowledge Article from www.Key-to-Steel.com, Aug. 16, 2004, http://key-to-steel.com/ViewArticle.asp?ID=62, 4 pgs.

"How Steel is Made," UK Steel Association, 1999, http://www.uksteel.org.uk.htm, 5 pgs.

"The Metallurgy of Carbon Steel," Aug. 13, 2004, http://www.gowelding.com/met/carbon.htm, 5 pgs.

Jones, Jeremy A.T., "Electric Arc Furnace Steelmaking," American Iron and Steel Institute: Steel Works, Sep. 3, 2004, http://www.steel.org/learning/howmade/eaf.htm, 16 pgs.

Kozak, Bruce, et al., "Continous Casting of Steel: Basic Principles," American Iron and Steel Institute: Steel Works, Sep. 20, 2004, http://www.steel.org/learning/howmade/concast.htm, 10 pgs.

* cited by examiner

METHOD FOR MAKING STRAIN AGING RESISTANT STEEL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The present disclosure relates generally to methods for modifying the chemistry in steel. More specifically, the method relates to forming a strain aging resistant steel by using nitride-forming elements, such as boron, to limit the free nitrogen content in high-carbon steel, or to meet a free nitrogen content specification in either high or low-carbon steel.

Steel is generally classified as either high-carbon steel or low-carbon steel. Generally, low-carbon steel contains less than 0.25 percent carbon, and high-carbon steel contains more than 0.25 percent carbon. Low-carbon steel is tough and ductile and is used for screws, nails, automotive body panels, and similar products that do not have critical strength requirements. Toughness is defined as the capacity of the steel to absorb energy without fracturing. Ductility is defined as the ability of steel to undergo permanent changes in shape without fracturing at room temperature.

High-carbon steel is much harder than low-carbon steel due to the presence of both iron carbide (cementite) and iron that form pearlite in the steel. High-carbon steel is used for manufacturing parts that have critical strength requirements, such as shafts, axles, gears, crankshafts, couplings, forgings, rails, railway wheels, and rail axles. High-carbon steel can be heat-treated to high hardness, but loses its toughness and ductility. Hardness is defined as the degree to which the steel will resist cutting, abrasion, penetration, bending and stretching. High tensile strength typically corresponds with high hardness.

One method for making steel products is by refining iron ore into steel. First, iron ore is mined from the earth and transported to a steel mill. The iron ore is then mixed with limestone and coal and heated in a blast furnace. The blast furnace melts the iron ore and removes most of the impurities from the liquid iron, creating a product called pig iron. The carbon content of the pig iron is too high for most steel products, so the pig iron is either further refined in its liquid form or cast into ingots for later use. In either case, the pig iron must be refined to reduce the carbon content and form usable liquid steel. The liquid steel may then be cast into slabs or billets for later processing into steel products.

A downside to this method for making steel products is the expense associated with mining and refining the iron ore into pig iron. One solution is to use direct reduced iron, which is iron ore that has been crushed and refined using large amounts of natural gas. However, the economic attractiveness of direct reduced iron is highly dependent upon the price of natural gas; therefore, direct reduced iron is not always a viable option. Steel mills have found that the use of scrap steel is an attractive alternative to either pig iron or direct reduced iron. The scrap steel is melted into liquid steel using an electric arc furnace or a basic oxygen furnace. The liquid steel can then be cast into slabs or billets. If an electric arc furnace is used, the furnace is charged with the scrap steel, and three graphite electrodes inside the furnace create electric arcs that melt the steel scrap into liquid steel. By contrast, if a basic oxygen furnace is used, the furnace is charged with a mixture of scrap and liquid pig iron, and oxygen is blown into the liquid steel to melt the scrap and purify the steel. The liquid steel is then transferred to a ladle metallurgy furnace (LMF) where the chemistry of the liquid steel is adjusted to meet a steel specification. The liquid steel may then be used to make steel products. The use of scrap steel in an electric arc furnace is typically the most cost-effective method for manufacturing steel products.

A commonly manufactured steel product is steel wire. Steel mills manufacture steel wire by forming a billet, rolling the billet into a steel rod, and then cold drawing the rod to form a wire. Cold drawing is the process of forcing a steel rod though a die to elongate and reduce its diameter. The steel rod is not heated before or as it is being forced through the die, hence the name "cold drawing." When the steel rod exits the die, the rod is called a wire. The cold drawing process may be repeated using increasingly smaller diameter dies to produce a wire of any diameter. The wire may be heat treated after wire drawing for improved mechanical properties. The wire may then be sold as bulk wire or may be formed into wire products, such as lacing wire or springs.

One problem that occurs when wire is cold drawn is strain aging. Strain aging is a condition where the ductility of the steel is reduced such that the steel becomes brittle, and therefore cracks and breaks rather than bends during the subsequent forming process. There are two main types of strain aging: dynamic strain aging and static strain aging. Dynamic strain aging occurs when the rod is cold drawn to form the wire. Static strain aging occurs between the time when the wire is cold drawn and the time when it is formed into a wire product. Strain aging is a significant problem in the steel industry and has been widely discussed in the prior art.

One of the primary causes of both dynamic and static strain aging is the presence of large quantities of "free nitrogen" dissolved within the steel. All of the free nitrogen dissolved within the steel is present as atomic nitrogen. Experiments have shown that when the nitrogen content of steel is greater than about 80 ppm, the steel will exhibit strain aging, and that strain aging is substantially reduced or eliminated when the nitrogen content of steel is below about 65 ppm, about 60 ppm, and preferably about 50 ppm. On an atomic level, strain aging is caused by the relatively small nitrogen atoms impeding the movement of dislocations within the iron atom matrix as the steel passes though the die. It is widely believed that if the movement of free nitrogen within the iron matrix is reduced or "stabilized," then dislocations can move easier within the iron matrix and strain aging will be reduced or eliminated. Therefore, a need exists for a method of making steel in which the free nitrogen in the steel is stabilized, thereby increasing the steel's resistance to strain aging.

Table 1 below outlines the nitrogen content of steel by different processes:

TABLE 1

| Steel Making Process | Typical Nitrogen Content |
|---|---|
| Basic Oxygen Furnace Using Pig Iron and Steel Scrap | 20-40 ppm |

TABLE 1-continued

| Steel Making Process | Typical Nitrogen Content |
|---|---|
| Electric Arc Furnace Using Steel Scrap and Combinations of Pig Iron and Direct Reduced Iron | 50-80 ppm |
| Electric Arc Furnace Using Steel Scrap Only | 50-100 ppm |

Thus, strain aging is particularly problematic in steel produced using an electric arc furnace because such steel has a higher nitrogen content. This is due, in part, to the use of scrap steel, which has a higher nitrogen content than pig iron or direct reduced iron. As a result, the liquid steel formed from scrap steel has a higher nitrogen content than the liquid steel formed from either pig iron or direct reduced iron. In addition, the electric arc from the electrodes causes molecular nitrogen in the air ($N_2$) to dissociate into atomic nitrogen, which is easily absorbed by the liquid steel. Thus, unless the steel mill implements a nitrogen-reduction process, the nitrogen content of the solidified steel will be even higher than the nitrogen content of the steel scrap used to charge the furnace.

The conventional methods for controlling the nitrogen content of the steel involve the use of additional carbon in the charge, additional oxygen during refining, shielding gases during refining, and/or shrouding equipment during transfer and casting. One of the chemical reactions that occurs in the liquid steel is the interaction of carbon and oxygen, which produces carbon monoxide (CO). Because one of the byproducts of the carbon-oxygen reaction is removal of nitrogen from the liquid steel, the amount of carbon and/or oxygen in the liquid steel can be increased to control the nitrogen content of the steel. The carbon content can be increased by using additional charge carbon, injected carbon, pig iron, or direct reduced iron in the steel. The oxygen content can be increased by adding additional oxygen gas to the liquid steel. In either case, the modified refining process requires more raw materials and/or more expensive raw materials and more processing time than steel production methods in which the nitrogen content is not controlled. An additional method of controlling the nitrogen content of the steel is to use a shielding gas, such as argon, to stir the steel and shield the steel from the nitrogen in the atmosphere. By bubbling the shielding gas through the liquid steel to stir it and covering the surface of the liquid steel with a layer of the shielding gas, the amount of nitrogen the steel absorbs from the atmosphere can be controlled. Moreover, the amount of nitrogen the steel absorbs from the atmosphere can be controlled by using shrouding equipment when transferring the steel between the melting furnace, the LMF, and the caster. Shrouding equipment is also effective at controlling the amount of nitrogen the steel absorbs from the atmosphere when the steel is being cast.

The aforementioned methods for controlling the nitrogen content of the steel are not preferred because they significantly increase the cost of producing the steel and/or substantially reduce the throughput rate of steel production. The use of additional charge and injected carbon and carbon in the form of pig iron and/or direct reduced iron increases the cost of the raw materials. The use of additional oxygen during refining increases the cost of the raw materials and requires additional refining time, thereby decreasing the throughput rate of the steel production. Shielding gases, such as argon, increase the production cost of the steel because the shielding gas is generally not recoverable once used. Finally, the use of shrouding equipment increases the capital cost of the steel mill, which when amortized over the life of the equipment, increases the production cost of the steel. If a method for reducing the nitrogen content of the steel existed, then the aforementioned methods for controlling the nitrogen content of the steel would be unnecessary. In other words, if a method for reducing the nitrogen in the steel existed, then steel could be produced without regard for its nitrogen content and the nitrogen content of the steel could be reduced using the nitrogen reduction method. Consequently, a need exists for a method of reducing the nitrogen content of steel.

The conventional methods of reducing the nitrogen content of steel are also not preferred due to concerns about the costs and/or lowered productivity associated with these methods. Another method for limiting the nitrogen content of steel is to refine the steel using a basic oxygen furnace instead of an electric arc furnace. However, basic oxygen furnaces have two disadvantages: they are more expensive to install and operate and they require a charge comprising a mixture of scrap and liquid pig iron. Another method for limiting the nitrogen content in steel is to use a vacuum degasser on the LMF. A vacuum degasser operates under the principle that the nitrogen in the steel is in equilibrium with the nitrogen in the air above the liquid steel. The vacuum degasser lowers the pressure of the air (i.e. creates a vacuum) above the liquid metal, thereby lowering the partial pressure of the nitrogen in the air and causing the nitrogen in the steel to transfer from the liquid phase to the gaseous phase. However, vacuum-degassing equipment is expensive to purchase, install, and operate. The vacuum degassing process is also relatively time consuming because of the slowness in removing nitrogen from liquid steel under vacuum, which lowers the throughput rate of the steel mill. Consequently, a need exists for a simple, quick, and relatively inexpensive method to reduce the free nitrogen content in steel, thereby creating a strain aging resistant steel.

SUMMARY OF THE INVENTION

The present invention is directed to a method for making a strain aging resistant steel comprising adding boron to the steel wherein substantially all of the boron in the steel forms boron nitride, stabilizing the free nitrogen in the steel. In an embodiment, the method further comprises analyzing the chemistry of the steel, deoxidizing the steel, adding boron to the steel after the steel has been deoxidized, casting the steel into a billet, rolling the billet into a rod, and cold drawing the rod into a wire. In an embodiment, the pre-processed steel has a nitrogen content of at least about 50 ppm prior to adding the boron to the steel. In various embodiments, the resultant steel contains at least about 0.25 percent carbon, less than about 30 ppm oxygen, and less than about 80 ppm free nitrogen. The boron may be added to the steel in a stoichiometric amount to stabilize the free nitrogen in the steel such that the steel meets a free nitrogen content specification of less than about 80 ppm. The boron may be added to the steel in the form of a bulk boron alloy, a wire with a steel sheath and a boron core, or a boron powder.

In another aspect, the present invention is directed to a method for making steel comprising adding a nitride-forming element to the steel to lower the free nitrogen content of the steel to a free nitrogen content specification to make the steel strain aging resistant. In an embodiment, the nitride-forming element is boron and the nitride compound is boron nitride. Alternatively, the nitride-forming element may be selected from the group consisting of aluminum, vanadium, niobium, and titanium; and the nitride compound may be selected from the group consisting of aluminum nitride, vanadium nitride, niobium nitride, and titanium nitride. The free nitrogen content specification may be less than about 80 ppm. In an embodiment, the method further comprises casting the steel into a billet, rolling the billet into a rod, and cold drawing the rod into a wire. In various embodiments, the steel has a free nitrogen content of at least about 50 ppm prior to adding the boron to the steel, contains at least about 0.25 percent carbon, and contains less than about 30 ppm oxygen. In an embodiment, substantially all of the boron in the steel exists as boron nitride. The boron may be added to the steel in the form of a bulk boron alloy or a wire with a steel sheath and a boron core.

In yet another aspect, the present invention comprises a high-carbon, strain aging resistant steel containing boron nitride; wherein the free nitrogen content of the steel is less than about 80 ppm. In an embodiment, substantially all of the boron in the steel exists as boron nitride. In various embodiments, the steel has a free nitrogen content of at least about 50 ppm prior to adding the boron to the steel, contains at least about 0.25 percent carbon, and contains less than about 30 ppm oxygen. The final steel may contain less than about 65 ppm free nitrogen.

In still another aspect, the present invention comprises a strain aging resistant steel wherein the carbon content of the steel is between about 0.54 percent and about 0.75 percent. In an embodiment, substantially all of the boron in the steel exists as boron nitride. In various embodiments, the steel contains less than about 30 ppm oxygen and less than about 80 ppm free nitrogen.

BRIEF DESCRIPTION OF THE DRAWINGS

For a more complete understanding of the present invention, and for further details and advantages thereof, reference is now made to the accompanying drawings, in which.

DETAILED DESCRIPTION OF THE INVENTION

Figure 1:
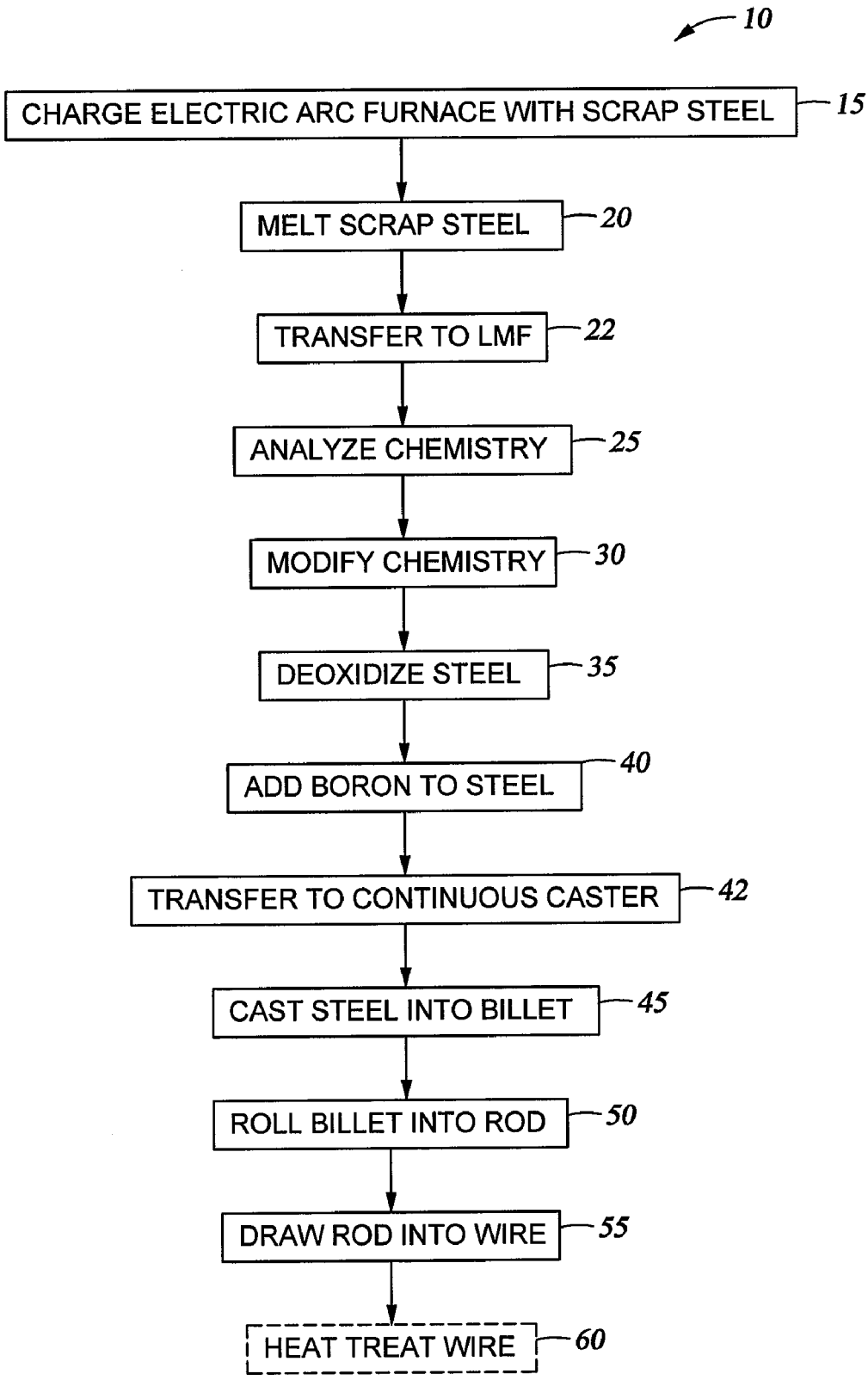
FIG. 1 is a block diagram of one embodiment of a method for making strain aging resistant steel.

FIG. 1 depicts a block diagram of the major steps comprising one embodiment of a method 10 for making strain aging resistant steel. The method 10 comprises charging an electric arc furnace with scrap steel 15, melting the scrap steel 20, transferring the liquid steel to a ladle metallurgy furnace (LMF) 22, analyzing the chemistry of the steel 25, modifying the chemistry of the steel 30, deoxidizing the steel 35, and adding boron to the steel 40. The method 10 further comprises transferring the liquid steel to a continuous caster 42, casting it into billets 45, rolling the billets into rods 50, cold drawing the rods into wire 55, and optionally heat treating the wire 60. Each of these steps is described in greater detail below.

Figure 2:
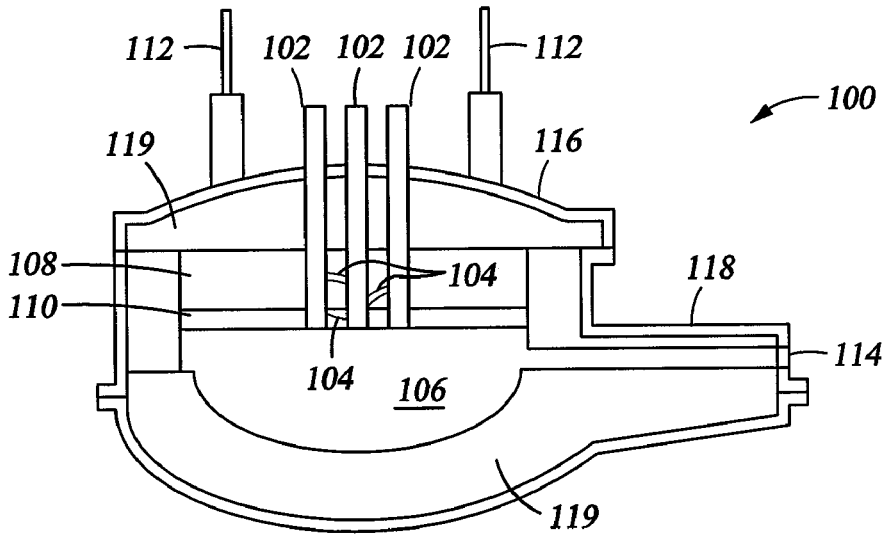
FIG. 2 is a side view of one embodiment of an electric arc furnace used to implement the method of FIG. 1 making strain aging resistant steel.

FIG. 2 is an illustration of one embodiment of an electric arc furnace 100 used to melt the scrap steel into liquid steel per step 20 of FIG. 1. Although the specific design varies from one steel mill to another, the electric arc furnace 100 generally comprises a shell 118 and a roof 116. Both the shell 118 and the roof 116 may be manufactured of steel plate, the interior of which is lined with refractory 119 and/or water cooled panels (not shown). The roof 116 contains three graphite electrodes 102, each of which are connected to an electrical power source (not shown). The electrodes 102 generate electric arcs 104 between each other. A plurality of supports 112 allow the roof 116 to be retracted with respect to the shell 118. The shell 118 contains a tap 114 that may be opened to drain the liquid steel out of the electric arc furnace 100.

The electric arc furnace 100 operates to produce batches of liquid steel. The process usually begins with the retraction of the roof 116 away from the shell 118. If necessary, the interior of the electric arc furnace 100 is inspected and repaired during this time. The electric arc furnace 100 is then charged with scrap steel per step 15 of FIG. 1. If desired, fluxes, charge carbon, and alloying metals (not shown), such as molybdenum, manganese, and chromium, are added to the scrap steel to make the composition of the liquid steel closer to the final steel specification. When the electric arc furnace is sufficiently charged with scrap steel, the roof 116 is lowered to be positioned on top of the shell 118 and electric power is supplied to the electrodes 102. The arcs 104 melt the scrap steel into liquid steel 106 per step 20 of FIG. 1. As the scrap steel melts into liquid steel 106, a layer of slag 110 forms between the liquid steel 106 and the gases 108 in the electric arc furnace 100. If the scrap steel charge contains alloying metals, the alloying metals melt with the scrap steel. Optionally, additional charges of scrap steel may be added to the electric arc furnace 100. When the scrap steel, additional charges, and/or alloying metals are completely melted and refined into liquid steel 106, the electric arc furnace 100 is tapped by draining the liquid steel out of the tap 114. Additives including fluxes, carbon, and alloys may be added during the tapping step. The semi finished liquid steel 106 is then transferred per step 22 of FIG. 1 to the LMF 120 shown in FIG. 3, where the liquid steel is further refined to the final specification.

It should be understood that the method for making strain aging resistant steel is not to be limited to the use of scrap steel melted in an electric arc furnace 100. Instead, the method may also include the use of steel scrap, pig iron, direct reduced iron, and combinations thereof in an electric arc furnace, a basic oxygen furnace, or other types of furnaces.

Figure 3:
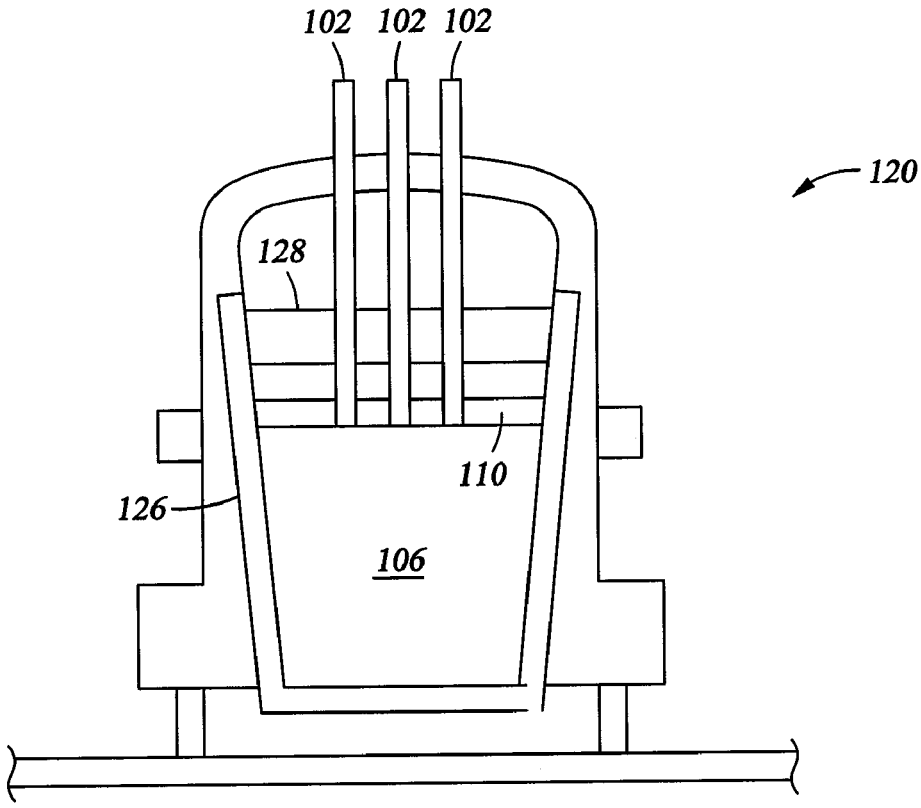
FIG. 3 is a side view of one embodiment of a ladle metallurgy furnace (LMF) used to implement the method of FIG. 1 for making strain aging resistant steel.

FIG. 3 is an illustration of a LMF 120 used to modify the chemistry of the steel, analyze the chemistry of the steel, deoxidize the steel, and add boron to the steel according to steps 25, 30, 35, and 40 of FIG. 1. Much like the electric arc furnace 100, the LMF 120 generally comprises a ladle shell 126 and a roof 128. The LMF 120 also comprises an alloy addition system, a gaseous or electromagnetic stirring system, and a wire injection system. Samples for chemical analysis are taken with disposable probes that are inserted into the liquid steel 106. The LMF 120 is also equipped with graphite electrodes 102 for the purpose of heating the liquid steel 106, and a porous plug arrangement (not shown) for bubbling gas through the liquid steel 106 to stir and mix it. The LMF 120 may also comprise additional apparatuses other than those described herein.

After the liquid steel 106 is transferred from the electric arc furnace 100 into the LMF 120 per step 22 of FIG. 1, the chemical composition of the liquid steel 106 is analyzed in accordance with step 25 of FIG. 1. The chemical composition identifies the content of several important elements in the steel, including: carbon, manganese, phosphorous, sulfur, silicon, copper, nickel, chromium, molybdenum, aluminum, nitrogen, boron, vanadium, and niobium. Oxygen is measured with immersion probes. The LMF operator uses the chemical composition of the liquid steel 106 to determine which refining processes to implement on the liquid steel 106 to meet a steel specification. While there are several steel specifications, the most widely recognized specifications are those provided by the American Society for Testing and Materials (ASTM) and the American Iron and Steel Institute (AISI). Customer specifications are also frequently used. The method for making strain aging resistant steel includes steel specifications other than the steel specifications described herein and the method is not limited to any of the aforementioned steel specifications.

After the chemical composition of the steel has been analyzed, the chemical composition of the liquid steel 106 may be modified by adding alloys in bulk or as wire, carbon, and fluxes, to the liquid steel or implementing various processes on the steel in accordance with step 30 of FIG. 1. For example, if the manganese content of the steel is too low for the steel specification, manganese may be added to the liquid steel 106 as a ferro alloy or as a pure metal. As another example, if the carbon content of the steel is too low, carbon can be added as a cored wire or in bulk form. As the chemistry of the liquid steel 106 is being modified, the steel mill may periodically re-analyze and monitor the chemical composition of the steel. The method for making strain aging resistant steel also includes chemical content additions and processes other than those described herein, and the method for is not limited to any of the aforementioned additions and processes.

After the chemical composition of the steel has been modified, the steel mill deoxidizes the steel in accordance with step 35 of FIG. 1. Deoxidizers such as silicon or manganese reduce the oxygen content to a level where no reaction occurs between carbon and oxygen during solidification. In the preferred deoxidation process, silicon, calcium, or a combination is added to the steel until the oxygen content of the steel is reduced to a specification level, such as less than about 100 parts per million (ppm). In an embodiment, the oxygen content is reduced to less than about 30 ppm. In another embodiment, the oxygen content is reduced to less than about 20 ppm so that when a nitride-forming element is added to the steel, the nitride-forming element reacts with the free nitrogen to form nitrides instead of reacting with the oxygen to form oxides. The method for making strain aging resistant steel also includes steel deoxidation methods other than those described herein, and the method is not limited to the aforementioned steel deoxidation methods.

After the steel has been deoxidized, the steel mill adds a nitride-forming element to stabilize the free nitrogen in the steel in accordance with step 40 of FIG. 1. Several nitride-forming elements are suitable for making strain aging resistant steel, including: boron, aluminum, titanium, vanadium, and niobium (also called columbium). Generally, the nitride-forming element reacts with free nitrogen to form a binary molecule (i.e. $B+N \rightarrow BN$). However, some nitride-forming elements, such as vanadium, also form more complex molecules (i.e. $4V+N \rightarrow V_4N$). Selection of a specific nitride-forming element varies from application to application depending upon the end-use for the steel, and upon the carbon, nitrogen, and oxygen content in the steel, which is important because some nitride-forming elements prefer to form carbides and oxides instead of nitrides. The formation of carbides and oxides does not necessarily have an adverse affect on the steel, but a greater amount of nitride-forming element is required to reduce the free nitrogen content to a specified level when the nitride-forming element also forms carbides and oxides. The method for making strain aging resistant steel also includes nitride-forming elements other than those described herein, and the method is not limited to the aforementioned nitride-forming elements.

In another embodiment, boron is the selected nitride-forming element because boron prefers to form nitrides over oxides and carbides, and the boron nitride is not harmful to the finished wire. In more detail, many nitride-forming elements, such as aluminum, prefer to form oxides instead of nitrides. Because most steel specifications do not have a lower limit for oxygen content, the oxide formation can be controlled by reducing or eliminating the oxygen content in the steel during the deoxidation process. However, nitride-forming elements with a high oxygen affinity, such as aluminum, will seek to bond with oxygen and further deoxidize the steel rather than bond with nitrogen and stabilize the free nitrogen in the steel.

Likewise, some nitride-forming elements, such as titanium, prefer to form carbides over nitrides. Because steel specifications set upper and lower limits for carbon content, the formation of carbides cannot be controlled by simply limiting the carbon content in the steel. Thus, in high-carbon steels, nitride-forming elements with an affinity for carbides are not preferred because such elements will bond with carbon to form carbides instead of bonding with free nitrogen to form nitrides.

Accordingly, nitride-forming elements, such as boron, having a strong affinity for forming nitrides over oxides or carbides are preferred in high-carbon steels, and are also suitable for steel with any carbon content. For example, even in high-carbon steel, substantially all of the boron will form boron nitride with minimal boron carbide formation. Similarly, in higher oxygen steel, most of the boron will form boron nitride with minimal boron oxide formation. Consequently, boron is an excellent nitride-forming element because boron has a strong preference for forming nitrides over oxides or carbides.

Boron is also an advantageous nitride-forming element because of its cost and the stoichiometric efficiency with which boron forms nitrides. The amount of nitride-forming element required to bond with a specified amount of free nitrogen is dependent upon the atomic weight of nitrogen, the atomic weight of the nitride-forming element, and the coefficients of the balanced chemical reaction. The content of the nitride-forming element can be calculated using the following equation:

$$\text{Content}_{NFE}=[(\text{Content}_N)\times(MW_{NFE})\times(\text{Coefficient}_{NFE})] \div[(MW_N)\times(\text{Coefficient}_N)] \quad (1)$$

Where:

"$\text{Content}_{NFE}$" is the amount of nitride-forming element required to stabilize the nitrogen in the steel (in ppm);

"$MW_{NFE}$" is the molecular weight of the nitride-forming element (in grams per mole);

"$\text{Coefficient}_{NFE}$" is the coefficient of the nitride-forming element reactant in the stoichiometrically balanced reaction equation;

"$\text{Content}_N$" is the amount of free nitrogen to be removed from the steel (in ppm);

"$MW_N$" is the molecular weight of nitrogen (in grams per mole); and

"$\text{Coefficient}_N$" is the coefficient of the nitrogen reactant in the balanced reaction equation. Applying the above equation to the boron nitride reaction ($B+N \rightarrow BN$), in which the boron and nitrogen coefficients are both 1, it is evident that only 0.77 ppm of boron is required to react with 1 ppm of free nitrogen. By contrast, 3.42 ppm of titanium and 6.64 ppm of niobium, respectively, would be required to react with the same 1 ppm of free nitrogen. Because boron has the lowest molecular weight, less boron is required as compared to other nitride-forming elements. Boron is also less expensive than other nitride-forming elements, such as titanium and niobium. Consequently, the stoichiometric efficiency with which boron forms nitrides, coupled with the cost of boron, makes boron an excellent nitride-forming element for the method of making strain aging resistant steel.

The decision regarding whether to add a nitride-forming element, such as boron, to the liquid steel is based upon the nitrogen content of the steel. The amount of nitrogen allowed in the steel varies from specification to specification and is commonly based upon the desired physical properties of the resultant steel. In some types of steel, the steel specification limits the nitrogen content to less than about 80 ppm nitrogen. Thus, if the steel has a nitrogen content of less than about 80 ppm, then there is no need to add a nitride-forming element to the steel. Further, many steel specifications limit the nitrogen content to a maximum of about 65 ppm, while others limit the nitrogen content to a maximum of about 60 ppm or a maximum of about 50 ppm. Thus, it may be necessary to limit the nitrogen content of the steel to about 80 ppm, about 65 ppm, about 60 ppm, or about 50 ppm. Alternatively, the steel mill can limit the nitrogen content to any other amount as described in a specification and/or customer requirement. The liquid steel will absorb an incidental amount of nitrogen, usually between about 5 ppm and about 15 ppm, between the time the chemical composition is analyzed and the time the liquid steel solidifies. This nitrogen absorption is taken into account when deciding whether or not to add the nitride-forming element to the liquid steel. Because the liquid steel acquires the majority of its nitrogen from either the steel charge or the dissociation of molecular nitrogen by the electricity, if the nitrogen content of the steel does not exceed the nitrogen content in the specification minus the expected nitrogen absorption, then there is generally no need to add a nitride-forming element to the steel. Instead, the steel is sent directly to the caster.

In a majority of cases, particularly when an electric arc furnace is used to melt scrap steel, the nitrogen content of the steel exceeds about 80 ppm, so there is a need to stabilize the free nitrogen in the steel by adding a nitride-forming element, such as boron, to the steel. The amount of nitride-forming element to add to the steel is based upon the amount of nitrogen to be stabilized, which may be calculated using the following equation:

$$\text{Content}_N \text{ to be Stabilized} = (\text{Content}_N \text{ of the Steel} - \text{Content}_N \text{ in the Specification}) \quad (2)$$

Where:

"$\text{Content}_N$ to be Stabilized" is the amount of free nitrogen in the steel that needs to be stabilized to bring the steel into conformance with the specification;

"$\text{Content}_N$ of the Steel" is the amount of free nitrogen in the steel before adding any nitride-forming elements; and "$\text{Content}_N$ in the Specification" is the maximum free nitrogen content of the specification. By using the "$\text{Content}_N$ to be Stabilized" in equation 2 as the "$\text{Content}_N$" in equation 1, the amount of nitride-forming element required to bring the steel into conformance with the specification can be determined. For example, if the nitrogen content of the steel is 100 ppm, the nitrogen specification is 60 ppm maximum, and boron is the nitride-forming element, then 30.9 ppm of boron (30.9 milligrams of boron per kilogram of steel) should be added to the steel. Because the liquid steel tends to absorb some free nitrogen (typically 5-15 ppm) between the chemical composition analysis in the LMF and solidification of the steel, an additional 5-15 ppm of free nitrogen in the steel should be stabilized to ensure compliance with the steel specification. For example, if the nitrogen content of the steel is 100 ppm, the nitrogen specification is 60 ppm maximum, an additional 10 ppm of nitrogen is to be stabilized, and boron is the nitride-forming element, then 38.6 ppm of boron (38.6 milligrams of boron per kilogram of steel) should be added to the steel. Thus, equation 1 and equation 2 may be used to calculate the amount of nitride-forming element to add to the steel regardless of the nitride-forming element selected, the nitrogen content of the steel prior to adding the nitride-forming element, or the nitrogen content of the steel specification.

The nitride-forming element is added to the liquid steel in a variety of forms. For example, using boron as the nitride-forming element, the boron may be added as a bulk ferro-boron alloy, or injected into the liquid steel as a boron powder or as a steel sheathed wire with a ferro-boron powder core. The wire injection method is advantageous because the wire may be injected directly into the liquid steel using a wire feeder (not shown), which leads to better mixing of the boron with the steel, and thus a more complete reaction between the boron and the free nitrogen. The method for making strain aging resistant steel also includes methods for adding nitride-forming elements to liquid steel by processes other than those described herein, and the method is not limited to the aforementioned processes for adding nitride-forming elements to liquid steel.

Figure 4:
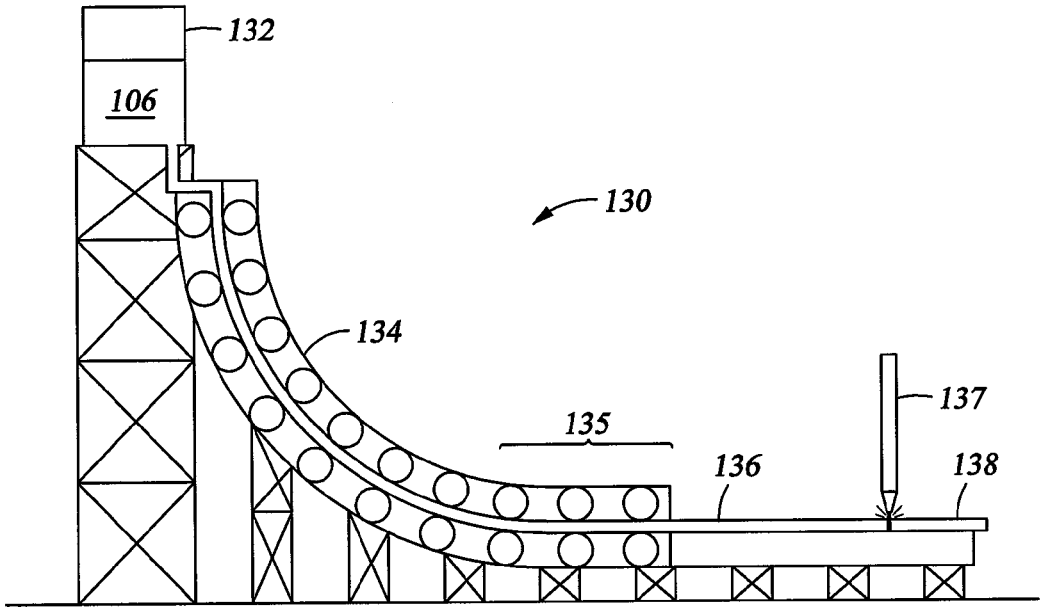
FIG. 4 is a side view of one embodiment of a continuous caster used to implement the method of FIG. 1 for making strain aging resistant steel.

After the nitride-forming element has been added to the liquid steel and the free nitrogen stabilized, the liquid steel is transferred to a caster for casting in accordance with steps 42 and 45 of FIG. 1. FIG. 4 is an illustration of one embodiment of a continuous caster 130 suitable for implementing the method for making strain aging resistant steel. Although the method for making strain aging resistant steel may utilize a batch casting process in which the liquid steel is poured into stationary molds to form ingots, continuous casting is more efficient. As depicted in FIG. 4, the liquid steel 106 is poured from the LMF (not shown) into a tundish 132. The tundish 132 is essentially an open-topped tank that feeds the liquid steel 106 into one or more mold(s) 134 at a regulated rate. The tundish 132 is designed to continuously supply liquid steel 106 to the mold(s) 134 at a specific flow rate through nozzles in the bottom of the tundish 132. Cooling water (not shown) flows through the mold(s) 134 and cools the exterior of the mold(s) 134 to a temperature below the solidification temperature of the steel. The mold(s) 134 is constructed of a heat conductive material, preferably copper, and consequently the interior of the mold(s) 134 cools the exterior of the liquid steel 106, thereby transforming it into a steel shell with a liquid steel core. As the steel continues to move down through the caster 130, spray water directly on the outer shell continues to cool the steel until the liquid core solidifies into solid steel 136. The solid steel 136 then passes through a straightener 135 that straightens out the arc shape that the solid steel 136 acquired during casting. The straightened steel 136 is cut by a torch 137, thereby forming a plurality of billets 138. Alternatively, the casting process can produce shapes other than billets, such as blooms, rounds, beam blanks, conventional slabs, or thin slabs. The method for making strain aging resistant steel also includes casting processes other than those described herein, and the method is not limited to the aforementioned casting processes.

After the billets 138 are formed, the billets 138 are rolled into rods at a rolling mill in accordance with step 50 of FIG. 1. The billets 138 produced by the caster 130 are square, rectangular, or round in cross-section, and are large in comparison to wire diameters. However, the dies used to draw the wire are small round-shaped and wear prematurely unless round-shaped rods are inserted into the dies. Therefore, the square or rectangular billets 138 must be reshaped into rods with a much smaller circular cross-section. A rolling mill is a machine or group of machines that works the rectangular billets 138 into round bars by rolling the billets 138 under pressure until the billets 138 are much reduced in size and become round. The rolling process is done hot wherein the temperature exceeds the recrystallization temperature of the steel. Hot rolled rods are beneficial because the steel does not strain harden during the rolling process. The method for making strain aging resistant steel also includes rolling processes other than those described herein, and the method is not limited to the aforementioned rolling processes.

Figure 5:
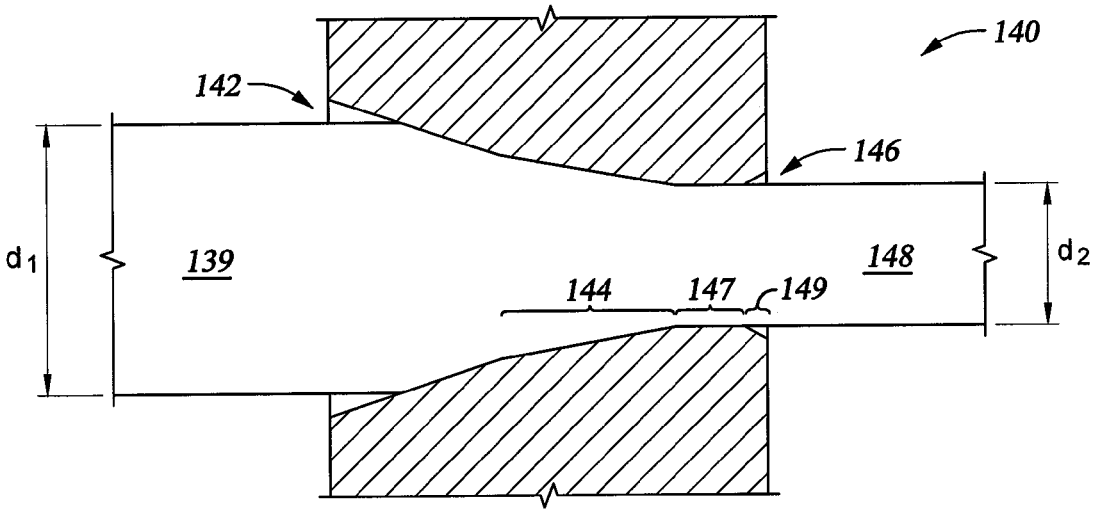
FIG. 5 is a cross-sectional view of one embodiment of a die used to implement the method of FIG. 1 for making strain aging resistant steel.

After the billets 138 are rolled into rods, the rods are cold drawn through a series of dies to produce drawn wire in accordance with step 55 of FIG. 1. FIG. 5 is an illustration of a die 140, comprising an inlet 142, a throat 144, and an outlet 146. As depicted in FIG. 5, the inlet 142 is sized to accept rods 139 of various diameters, $d_1$. The inlet 142 partially constricts larger diameter rods 139; however, the majority of the constricting work is performed by throat 144. The throat 144 constricts the rod 139 down to a wire 148 with a diameter $d_2$. As the rod 139 is constricted, the iron atoms in the steel move along slip planes by dislocation movement and reorganize themselves into the smaller diameter wire 148. The constricting process also causes elongation of the steel such that the wire 148 exiting the die 140 is substantially longer than the rod 139 fed into the die 140. The outlet 146 of the die 140 includes a constant diameter section 147 and an expanding diameter section 149 which allows the steel to stabilize before exiting the die 140. If desired, a plurality of dies 140 may be implemented such that the process of drawing the rod 139 into the wire 148 occurs in a plurality of incremental steps. The wire 148 may then be spooled for sale or further processing. The method for making strain aging resistant steel also includes cold working and drawing processes other than those described herein, and the method is not limited to the aforementioned drawing processes.

After the wire 148 has been drawn, the wire 148 may optionally be heat treated in accordance with step 60 of FIG. 1. The process gives the wire 148 greater yield strength, but also makes the wire 148 more brittle and susceptible to breaking. The steel wire 148 containing the nitride-forming element is resistant to strain aging regardless of whether the wire 148 is heat treated or not. Thus, the decision regarding whether to heat treat the wire 148 depends upon the individual application for the wire 148. If the wire 148 is to be heat treated, one heat treating process comprises holding the wire at a temperature between about 450° F. and about 650° F. for about 10 to 20 minutes. The method for making strain aging resistant steel also includes heat-treating processes other than those described herein, and the method is not limited to the aforementioned heat treating processes.

After the wire 148 has been drawn and optionally heat treated, the wire 148 may be used for a variety of purposes. Generally, the diameter of the wire 148 governs its application. For example, wire that is about 0.050 inches in diameter is suitable for use as lacing wire for mattresses, and wire between about 0.007 inches and 0.014 inches in diameter is suitable for use as tire cords in pneumatic tires for vehicles. The wire 148 can also be formed into different shapes, such as helical shapes or springs. The method for making strain aging resistant steel also includes wire uses other than those described herein, and the method is not limited to the aforementioned wire uses.

EXAMPLE

The method for making strain aging resistant steel was implemented in a steel mill that produced wire according to the process of FIG. 1, including the heat treating step 60. The wire previously produced by the steel mill was 0.050 inch diameter lacing wire that exhibited strain aging. The lacing wire would frequently break when used to assemble mattress components. Twenty-six heats (individual batches of refined steel from a furnace) were made using the method of FIG. 1 making strain aging resistant steel. Boron was added to bring the steel into conformance with a specified free nitrogen content of 80 ppm maximum in the finished steel wire. Previous experiments had shown that the steel absorbed less than 20 ppm of free nitrogen between the LMF and the finished product. Therefore, in cases where the LMF nitrogen content was less than about 60 ppm, little or no boron was added to the LMF to stabilize the free nitrogen. Table 2 below shows the results of the experiment:

TABLE 2

| Heat # | Carbon Content (%) | LMF Nitrogen Content (ppm) | Boron Added to LMF (ppm) | Final Nitrogen Content (ppm) | Stabilized Nitrogen in the form of BN (ppm) | Free Nitrogen (ppm) |
|---|---|---|---|---|---|---|
| 1 | 0.66 | 51 | 0 | 69 | 0 | 69 |
| 2 | 0.69 | 61 | 6 | 63 | 8 | 55 |
| 3 | 0.67 | 59 | 0 | 69 | 0 | 69 |
| 4 | 0.68 | 59 | 0 | 72 | 0 | 72 |
| 5 | 0.70 | 68 | 9 | 76 | 11 | 65 |
| 6 | 0.71 | 75 | 13 | 86 | 17 | 69 |
| 7 | 0.72 | 65 | 16 | 71 | 20 | 51 |
| 8 | 0.75 | 66 | 6 | 68 | 8 | 60 |
| 9 | 0.73 | 56 | 0 | 77 | 0 | 77 |
| 10 | 0.77 | 61 | 0 | 64 | 0 | 64 |
| 11 | 0.59 | 76 | 20 | 78 | 25 | 53 |
| 12 | 0.58 | 59 | 0 | 61 | 0 | 61 |
| 13 | 0.59 | 68 | 15 | 78 | 19 | 59 |
| 14 | 0.57 | 52 | 0 | 71 | 0 | 71 |
| 15 | 0.57 | 53 | 0 | 71 | 0 | 71 |
| 16 | 0.57 | 57 | 1 | 58 | 1 | 57 |
| 17 | 0.56 | 50 | 0 | 68 | 0 | 68 |
| 18 | 0.61 | 68 | 11 | 69 | 14 | 55 |
| 19 | 0.60 | 76 | 4 | 74 | 5 | 69 |
| 20 | 0.63 | 58 | 1 | 75 | 1 | 74 |
| 21 | 0.57 | 67 | 11 | 72 | 14 | 58 |
| 22 | 0.58 | 61 | 1 | 63 | 1 | 62 |
| 23 | 0.56 | 56 | 0 | 61 | 0 | 61 |
| 24 | 0.55 | 64 | 1 | 63 | 1 | 62 |
| 25 | 0.56 | 55 | 0 | 71 | 0 | 71 |
| 26 | 0.54 | 52 | 0 | 65 | 0 | 65 |

The steel wire produced in all twenty-six heats did not exhibit strain aging, thereby supporting the conclusion that the addition of a nitride-forming element, such as boron, stabilizes the free nitrogen to substantially reduce or eliminate the effects of strain aging. In addition, the experiment shows that the method of making strain aging resistant steel is effective to produce steel conforming to a free nitrogen specification of 65 ppm, 60 ppm, and/or 50 ppm.

The method for making strain aging resistant steel may be applied to steel containing any level of carbon, but high-carbon steel, that is, steel containing at least about 0.25 percent carbon, is more susceptible to strain aging. Steel with a carbon content below 0.25 percent tends to be soft and ductile and generally does not exhibit harmful strain aging. If steel containing less than about 0.25 percent carbon exhibits strain aging, the method for making strain aging resistant steel may be utilized on the steel. However, the advantageous effects of the method for making strain aging resistant steel will generally be most appreciated in steel containing more than about 0.25 percent carbon. Most preferably, the method for making strain aging resistant steel is used on steel with a carbon content between about 0.54 percent and 0.77 percent, as illustrated in Table 2. Steel with a carbon content between about 0.54 percent and 0.77 percent is useful for making 0.050-inch lacing wire for mattresses. The method for making strain aging resistant steel may also be used on steel containing more than 0.77 percent carbon, if desired.

While several embodiments of the invention have been shown and described herein, modifications thereof may be made by one skilled in the art without departing from the spirit and the teachings of the invention. The embodiments described herein are provided for purposes of example only and are not intended to be limiting. Many variations, combinations, and modifications of the invention disclosed herein are possible and are within the scope of the invention. Accordingly, the scope of protection is not limited by the description set out above but is defined by the claims which follow, that scope including all equivalents of the subject matter of the claims.

What is claimed is:

1. A method for making a strain aging resistant steel comprising:

setting a free nitrogen content specification, wherein the free nitrogen content specification requires a free nitrogen content no more than a set ppm number, and the set ppm number is between about 50 ppm and about 80 ppm;

adding boron to a pre-processed steel to form a resultant steel with a free nitrogen content in conformance with the free nitrogen content specification;

wherein:

boron is only added to pre-processed steel having a free nitrogen content below the set ppm number of the free nitrogen content specification but by no more than 20 ppm below the set ppm number of the free nitrogen content specification to account for free nitrogen absorption that occurs prior to solidification of the resultant steel;

substantially all of the boron in the resultant steel forms boron nitride; and the resultant steel is strain aging resistant.

2. The method of claim 1 comprising:

analyzing the chemistry of the pre-processed steel;

deoxidizing the pre-processed steel; and adding boron to the pre-processed steel after the pre-processed steel has been deoxidized.

3. The method of claim 1 further comprising:

casting the resultant steel into a billet;

rolling the billet into a rod; and drawing the rod into a wire.

4. The method of claim 1 wherein the pre-processed steel is derived from an electric arc furnace.

5. The method of claim 1 wherein the resultant steel contains at least about 0.25 percent carbon.

6. The method of claim 1 wherein the resultant steel contains between about 0.25 percent and about 0.80 percent carbon.

7. The method of claim 1 wherein the resultant steel contains between about 0.54 percent and about 0.77 percent carbon.

8. The method of claim 2 wherein the pre-processed steel contains less than about 30 ppm oxygen after the pre-processed steel has been deoxidized.

9. The method of claim 1 further comprising: adding boron to the pre-processed steel in a stoichiometric amount to stabilize the free nitrogen in the resultant steel to account for expected free nitrogen absorption prior to solidification of the resultant steel while in conformance with the free nitrogen content specification.

10. The method of claim 9 wherein the free nitrogen content of the resultant steel is between about 50 ppm and about 80 ppm.

11. The method of claim 9 wherein the free nitrogen content of the resultant steel is between about 50 ppm and about 65 ppm.

12. The method of claim 1 wherein adding boron to the pre-processed steel comprises adding a bulk boron alloy to the pre-processed steel.

13. The method of claim 1 wherein adding boron to the pre-processed steel comprises adding wire with a steel sheath and a boron core to the pre-processed steel.

14. The method of claim 1 wherein adding boron to the pre-processed steel comprises adding boron powder to the pre-processed steel.

15. A method for making steel comprising:

setting a free nitrogen content specification;

adding to the steel a nitride-forming element operable to stabilize free nitrogen in the steel; and stabilizing free nitrogen in the steel to a level in conformance with the free nitrogen content specification;

wherein:

the free nitrogen content specification requires a free nitrogen content no more than a set ppm number, and the set ppm number is between about 50 ppm and about 80 ppm; and nitride-forming element is only added to steel having a free nitrogen content prior to adding the nitride-forming element to the steel below the set ppm number of the free nitrogen content specification, but by no more than 20 ppm below the set ppm number of the free nitrogen content specification, to account for free nitrogen absorption that occurs prior to solidification of the steel.

16. The method of claim 15 wherein the nitride-forming element is selected from the group consisting of: aluminum, vanadium, niobium, and titanium; and wherein the nitride compound is selected from the group consisting of: aluminum nitride, vanadium nitride, niobium nitride, and titanium nitride.

17. The method of claim 15 wherein the steel contains less than about 30 ppm oxygen prior to adding the nitride-forming element to the steel.

18. The method of claim 15 wherein the nitride-forming element is added to the steel in the form of a bulk alloy.

19. The method of claim 15 wherein the nitride-forming element is added to the steel in the form of a wire with a steel sheath and a nitride- forming element core.

20. The method of claim 15 wherein the free nitrogen content in the resultant steel is between about 50 ppm and about 80 ppm.

21. The method of claim 15 wherein the free nitrogen content in the resultant steel is between about 50 ppm and about 65 ppm.

22. The method of claim 15 further comprising:

casting the steel into a billet;

rolling the billet into a rod; and drawing the rod into a wire.

23. The method of claim 15 wherein the steel is derived from an electric arc furnace.

24. The method of claim 15 wherein the steel contains between about 0.25 percent and about 0.80 percent carbon.

25. The method of claim 15 wherein the steel contains between about 0.54 percent and about 0.77 percent carbon.

26. The method of claim 15 wherein:

the nitride-forming element has a strong affinity for forming nitrides over oxides or carbides; and substantially all of the nitride-forming element in the steel exists as a nitride compound.

27. The method of claim 26 wherein the nitride-forming element is selected from the group consisting of titanium and niobium.

28. The method of claim 27 wherein only a single nitride-forming element is added to the steel.

29. The method of claim 9 wherein the expected free nitrogen absorption is between about 5 ppm and about 20 ppm.

30. The method of claim 15 wherein nitride-forming element is added in an amount less than about 20 ppm.

31. The method of claim 15 further comprising determining an amount of nitride-forming element to add to the steel based on the nitrogen content of the steel prior to adding the nitride-forming element and the expected free nitrogen absorption prior to solidification of the steel, wherein the expected free nitrogen absorption is between about 5 ppm and about 20 ppm.

* * * * *